US006832980B2

(12) United States Patent
Hayasaka

(10) Patent No.: US 6,832,980 B2
(45) Date of Patent: Dec. 21, 2004

(54) CENTRIFUGE WITH SENSORS FOR DETECTING CENTRIFUGE CONDITIONS

(75) Inventor: Hiroshi Hayasaka, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 34 days.

(21) Appl. No.: 10/345,948

(22) Filed: Jan. 17, 2003

(65) Prior Publication Data

US 2003/0148867 A1 Aug. 7, 2003

(30) Foreign Application Priority Data

Feb. 1, 2002 (JP) ..... 2002-025559

(51) Int. Cl.[7] ..... B04B 5/02; B04B 13/00
(52) U.S. Cl. ..... 494/10; 494/20
(58) Field of Search ..... 494/1, 7, 9, 10, 494/11, 12, 16, 20, 33, 84; 422/72

(56) References Cited

U.S. PATENT DOCUMENTS 4,464,161 A * 8/1984 Uchida et al. ..... 494/7
5,322,497 A * 6/1994 Kobayashi ..... 494/20
6,383,126 B1 * 5/2002 Fondin ..... 494/7
6,491,615 B1 * 12/2002 Campbell et al. ..... 494/10

FOREIGN PATENT DOCUMENTS

FR 2629370 * 10/1989
JP 09-085130 3/1997

* cited by examiner

*Primary Examiner*—Charles E. Cooley
(74) *Attorney, Agent, or Firm*—Clark & Brody

(57) ABSTRACT

In a centrifuge comprising a rotor mounted on a drive shaft to be rotatable and having a plurality of bucket accommodating portions and a plurality of buckets placed in the bucket accommodating portions to be swingable, a plurality of sensors are provided to detect each of the buckets. In a case in which each of the sensors does not the bucket when the rotor is in a stop condition or in a low-speed rotation condition, a decision is made that an abnormality of a swinging movement of the bucket has occurred, and the fact of the occurrence of the abnormality is notified to a user. This allows abnormal conditions of the apparatus to be detected, thus protecting a sample and apparatus and enabling the maintenance of the apparatus in advance.

6 Claims, 1 Drawing Sheet

CENTRIFUGE WITH SENSORS FOR DETECTING CENTRIFUGE CONDITIONS

BACKGROUND OF THE INVENTION

1) Field of the Invention

The present invention relates to a centrifuge such as a centrifugal separator, and more particularly to a means for detecting an abnormal condition of a centrifuge.

2) Description of the Related Art

So far, there have been known various types of swing rotors for use in centrifuges, and as a general type, cylindrical rotor pins, which function as supporting points for swinging, are set on both side surfaces of a bucket for accommodating a sample or specimen and the bucket is mounted through these rotor pins to arm portions of the rotor. The rotor pins are located on the swing axis and are usually fixedly secured either to the rotor side or to the bucket side. The rotation of the rotor produces a centrifugal force to lift the bottom surface of the bucket, thereby enabling the swinging motion. During swinging, sliding occurs at pin side surfaces between the rotor pins and the pin bearing portions of the bucket, which requires frequent and periodical application of a lubricant or the like thereonto for the purpose of achieving secure swinging operations.

In the case of the swing rotor, because of the occurrence of the sliding phenomenon between the rotor pins and the pin bearing portion of the bucket as mentioned above, there is a possibility that the bucket stops halfway due to a friction therebetween so that the bucket does not return to the original position, that is, it does not return to a vertical condition, when the rotation of the rotor comes to stop. If a sample container is not in a covered condition, the sample can spill in the stopping condition. In addition, in the case of an automatic centrifuge in which a sample is automatically taken in and out, difficulty is frequently experienced in taking out the sample when the bucket does not return to the original position, thus leading to a loss of the sample or damages to the apparatus.

SUMMARY OF THE INVENTION

It is therefore an object of the present invention to detect abnormal conditions prior to the occurrence of the above-mentioned troubles for protecting a sample and apparatus, and further to enable maintenance of the apparatus in advance.

For this purpose, sensor means is provided to detect apparatus conditions including a stop of a rotor and a posture or position of a bucket prior to the stop of the rotor.

The sensor means is made to detect the posture or position of the bucket when the rotor is in a stop condition or in a low-speed rotation condition, and if the sensor means cannot detect the presence of the bucket, a decision is made that an abnormality of the swinging movement of the bucket has occurred, and the fact of the occurrence of the abnormality is notified to a user of the centrifuge. Moreover, if at least one of the sensor means detects the presence of the bucket when the rotor is in a rotation condition, a decision is made that the sensor means falls into an abnormal condition.

For connection of the bucket to the rotor, the holding position of the bucket is set to exist inwardly with respect to the center of gravity of the bucket in a radial direction of the rotor in a state where the bucket is in a stop condition.

A stopping member is provided inwardly with respect to the bucket to stop or bear the bucket to maintain the bucket at a vertical position when said rotor is in a stop condition or rotates at a speed below a predetermined value.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS

An embodiment of the present invention will be described hereinbelow with reference to the drawings.

Figure 1:
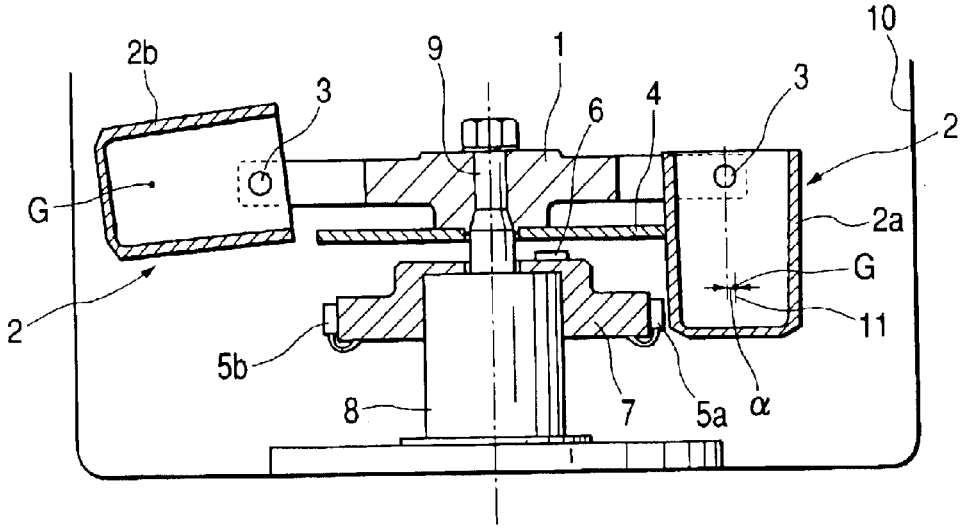
FIG. 1 is a cross-sectional view showing an internal construction of a rotation chamber of a centrifuge, where the left side illustrates a swinging condition of a bucket during a centrifugal operation (rotor rotation) while right side illustrates a stop condition of a rotor.
Figure 2:
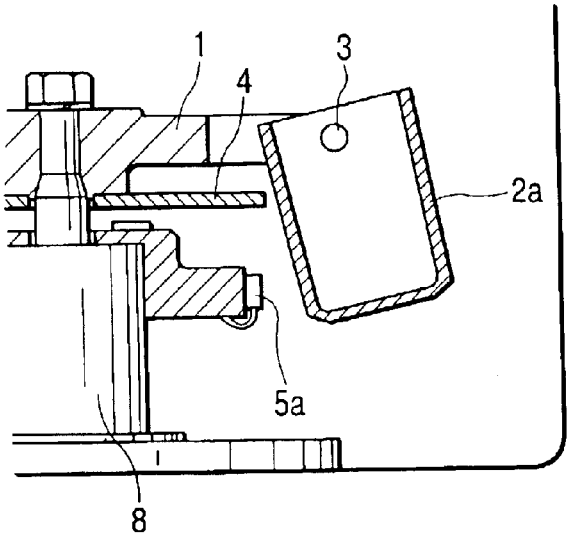
FIG. 2 is a cross-sectional view showing an example of an abnormal condition in a state where a rotor is in a stop condition.

Referring to FIGS. 1 and 2, a description will be given hereinbelow of a centrifuge with a swing rotor 1 according to the embodiment of the present invention, In FIGS. 1 and 2, the centrifuge according to this embodiment comprises a swing rotor (which will be referred to hereinafter as a "rotor") designated at reference numeral 1 and buckets, generally designated at reference numeral 2, which are made to accommodate a sample, specimen or the like. The rotor 1 is designed to be rotatable around a drive shaft 9 which is coupled to a drive apparatus 8 to be rotationally driven thereby. Each of the buckets 2 is placed in a bucket accommodating portion of the rotor 1, and is supported at its side portions by means of rotor pins 3 to be swingable about the rotor pins 3 in response to a centrifugal operation of the centrifuge.

In FIG. 1 showing an internal construction of a rotation chamber 10 of the centrifuge, the right side illustration thereof is for explaining a state of the bucket 2 (2*a*), that is, a stop condition of the bucket 2 (2*a*), when the rotor 1 is in a stop condition, where the bucket 2 (2*a*) suspends to fall into a vertical condition, while the left side illustration thereof is for explaining a state of the bucket 2 (2*b*), that is, a swinging (rotating) condition of the bucket 2 (2*b*), when the rotor 1 is rotationally driven through the drive shaft 9 by means of the drive apparatus 8 to conduct a centrifugation with respect to a sample or specimen placed in the bucket 2 (2*b*).

When the drive apparatus 8 starts up and the rotor 1 falls into a rotating condition, the bucket 2 starts to swing in a direction of an inner side wall of the rotation chamber 10 so that a side surface and bottom surface of the bucket 2 move gradually in an upward direction.

In this embodiment, the engagement construction between the bucket 2 and the rotor pins 3 is made as shown in the right side illustration of FIG. 1. That is, the engagement (insertion) positions of the rotor pins 3 with the bucket 2 (2*a*) are inwardly set a predetermined distance $\alpha$ away from the center G of gravity of the bucket 2. In other words, the rotor pins 3 are fitted in portions of the bucket 2 which are positioned inwardly by the predetermined distance $\alpha$ with respect to the axis 11 of the bucket 2 passing through the center G of the gravity of the bucket 2.

When the rotor 1 is in a stop condition, that is, when the bucket 2 is in the vertical condition, a side surface of the bucket 2 (2*a*) comes into contact with a stopper 4 located below the rotor 1. In this case, the outer circumferential dimension of the stopper 4 is set so that the bucket 2 takes a substantially vertical stop position.

In addition, the rotor 1 is fixedly fitted over the drive shaft 9, and a sensor holder 7 is fixedly secured onto an upper portion of a stationary part of the drive apparatus 8. This sensor holder 7 holds a plurality of bucket detection sensors 5 (5*a*, 5*b*) at its outer circumference. Each of these sensors 5 is constructed with a non-contact type proximity switch or the like, and is fixed at a position where it can detect the bucket 2 (2*a*) which comes into contact with the stopper 4 and takes the vertical condition. In this connection, since the positional relationship between the sensor 5 (5*a*) and the bucket 2 (2*a*) can be determined in conjunction with the positional relationship between the sensor 5 and the stopper 4, the positional relationship between the sensor 5 and the bucket 2 is adjustable even if the rotor 1 is removed. The sensors 5 are provided to correspond in number to the buckets 2, and through the use of a rotor position sensor 6 placed on an upper portion of the sensor holder 7, the rotor 1 is controlled to stop at a predetermined position, thereby detecting the presence or absence of the plurality of buckets 2 at the same time.

As obviously seen from FIG. 1, the sensors 5 detect the absence of the buckets 2 when the rotor 1 is in rotation, while detecting the presence of the buckets 2 when the rotor 1 is a stop condition. On the other hand, when the rotor 1 comes to a stop after the completion of the rotational operation thereof, if, for example, the friction between the bucket 2 (2*a*) and the rotor pins 3 increases so that the bucket 2 does not reach the stopper 4 position as shown in FIG. 2, the sensor 5 does not detect the presence of the bucket 2. This enables a decision to be made to the fact that the bucket 2 cannot return to the predetermined position, that is, an abnormality or failure on the swinging movement of the bucket 2 to the vertical position has occurred. The fact of no detection of the bucket is notified to a user of the centrifuge through the use of a proper means such as an alarm.

Although in this embodiment the bucket detection sensors 5 are provided to be equal in number to the buckets 2, the number of the bucket detection sensors 5 is reducible. That is, since the positions of the rotor pins 3 are set inwardly with respect to the position of the center of gravity of the bucket 2, in other words, since they are nearer to the center of rotation of the rotor 1 than the center G of gravity of the bucket 2, when the rotor 1 reaches a low-speed rotation condition, the bucket 2 takes a vertical condition in advance as well as the case in which the rotor 1 is in a stop condition. Accordingly, it is possible to achieve the detection on the presence or absence of the buckets 2 in succession when the rotor 1 is in this low-speed condition, i.e., below a speed of rotation. For example, it is realizable by counting the number of buckets 2 detected during one revolution. On the other hand, if the positions of the rotor pins 3 are set to coincide with the position of the center of gravity of the bucket 2, the detection according to a similar method is feasible through the use of a sensor which is capable of detecting a state immediately before the buckets 2 return to the vertical condition.

In addition, while the rotor 1 is in rotation, the bucket detection sensor 5 is in a non-detecting condition at all times. Accordingly, if this sensor 5 detects the presence of the bucket 2 during the rotation of the rotor 1, a decision can be made that the sensor 5 has fallen into a failure or abnormal condition. This enables the failure diagnosis on the sensor 5.

Still additionally, although in the above-described embodiment the bucket detection sensors 5 are fixed at predetermined positions, it is also appropriate that, conversely, the bucket detection sensors 5 are rotated (make one revolution) to detect the presence or absence of the buckets 2. In this case, determining only a detection start position previously, one or more bucket detection sensors 5 sufficiently achieve the detection thereof. In a case in which a plurality of bucket detection sensors 5 are put to use for the detection, the detection of the presence or absence of the buckets 2 becomes feasible without requiring one revolution of the rotor 1, which contributes to shortening the time needed for detection and improving the working efficiency or workability.

Moreover, although in the above-described embodiment a non-contact type proximity switch or the like is employed as the bucket detection sensor 5, it is also appropriate to employ a contact type switch. Still moreover, the above-mentioned contact type switch or non-contact type proximity switch or the like are not particularly limited to the positions mentioned in the above-described embodiment provided that the positions thereof allow secure detection of the buckets 2. For example, it is also appropriate that the switches are located in the interior (inner wall surface or bottom surface) of the rotation chamber 10, or that they are situated on a lower portion (a portion above the rotor 1) of a door (not shown) placed for closing the rotation chamber 10.

As described above, according to the present invention, it is possible to detect the abnormality of the swinging (returning) motion of the buckets by detecting the bucket positions when the rotor is in a stop condition, which protects a sample or specimen and the apparatus and permits the maintenance in advance.

It should be understood that the present invention is not limited to the above-described embodiment, and that it is intended to cover all changes and modifications of the embodiment of the invention herein which do not constitute departures from the spirit and scope of the invention.

What is claimed is:

1. A centrifuge comprising:

a rotor mounted on a drive shaft to be rotatable and having a plurality of bucket accommodating portions;

buckets placed in said bucket accommodating portions to be swingable; and sensor means for detecting each of said buckets;

the number of said sensor means being set to be equal to the number of said buckets, and the sensor means being placed at a location corresponding to each of said buckets.

2. The centrifuge according to claim 1, wherein the rotation of said rotor is stopped so that said sensor means confronts each of said buckets.

3. The centrifuge according to claim 1, wherein a position around which said bucket swings exists inwardly with respect to the center of gravity of said bucket in a radial direction of said rotor in a state where said bucket is in a stop condition, and a stopping member is provided on a central side of said rotor relative to said bucket to stop said bucket into a vertical position when said rotor rotates at a speed below a predetermined value.

4. A centrifuge comprising:

a rotor mounted on a drive shaft to be rotatable and having a plurality of bucket accommodating portions;

buckets placed in said bucket accommodating portions to be swingable; and sensor means for detecting each of said buckets;

a decision being made to the occurrence of an abnormality on a swinging movement of said bucket in a case in which said bucket is not detected when said rotor is in a stop condition or in a low-speed rotation condition, and the fact of the occurrence of the abnormality being notified to a user.

5. The centrifuge according to claim 4, wherein, when at least one of said sensor means does not detect the presence of said bucket when said rotor is in a stop condition, a decision is made to the occurrence of an abnormality on a swinging movement of said bucket, and the fact of the occurrence of the abnormality is notified to a user.

6. The centrifuge according to claim 4, wherein, when at least one of said sensor means detects the presence of said bucket when said rotor is in a rotation condition, a decision is made that said sensor means falls into an abnormal condition.

* * * * *